US006778153B2

(12) United States Patent
Kang

(10) Patent No.: US 6,778,153 B2
(45) Date of Patent: Aug. 17, 2004

(54) APPARATUS AND METHOD OF RECOVERING REACTIVE POWER OF PLASMA DISPLAY PANEL

(75) Inventor: Chun-seong Kang, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 160 days.

(21) Appl. No.: 10/197,672

(22) Filed: Jul. 18, 2002

(65) Prior Publication Data

US 2003/0156081 A1 Aug. 21, 2003

(30) Foreign Application Priority Data

Feb. 19, 2002 (KR) ..... 2002-8786

(51) Int. Cl.[7] ..... G09G 3/28
(52) U.S. Cl. ..... 345/60; 345/66; 315/169.4
(58) Field of Search ..... 345/60, 61–63, 345/66–70, 211, 37; 315/169.1, 169.3, 169.4

(56) References Cited

U.S. PATENT DOCUMENTS 6,150,999 A 11/2000 Chen et al.
6,160,531 A * 12/2000 Chen et al. ..... 345/60
6,249,279 B1 6/2001 Shirasawa
6,617,802 B2 * 9/2003 Roh ..... 315/169.4

FOREIGN PATENT DOCUMENTS

| | | |
|---|---|---|
| JP | 9-325735 | 12/1997 |
| JP | 11-338416 | 12/1999 |
| KR | 2000-15220 | 3/2000 |

* cited by examiner

*Primary Examiner*—Regina Liang
(74) *Attorney, Agent, or Firm*—Sughrue Mion, PLLC

(57) ABSTRACT

An apparatus to recover a reactive power of a plasma display panel, the apparatus including a power supply source, first and second discharge electrodes to perform a surface discharge with a voltage from the power supply source, a panel capacitor having opposite ends connected to the respective discharge electrodes and which is discharged by supplying a charge voltage to one of the first and second discharge electrodes, an inductor provided between the one of the first and second discharge electrodes and the panel capacitor. The inductor is charged by a discharge current of the panel capacitor and induces the charge voltage of the panel capacitor to be recovered.

25 Claims, 8 Drawing Sheets

APPARATUS AND METHOD OF RECOVERING REACTIVE POWER OF PLASMA DISPLAY PANEL

CROSS-REFERENCE TO RELATED APPLICATION

This application claims the benefit of Korean Application No. 2002-8786, filed Feb. 19, 2002, in the Korean Intellectual Property Office, the disclosure of which is incorporated herein by reference.

BACKGROUND OF THE INVENTION

1. Field of the Invention

The present invention relates in general to a plasma display apparatus which displays images thereon by use of an electric discharge, and more particularly, to a plasma display panel (hereinafter, a "PDP") having a circuit to recover reactive power.

2. Description of the Related Art

A PDP is an apparatus that allows pictures to be displayed thereon using a gas discharge. Depending upon types of methods used to drive the PDP, the PDP is largely categorized into a direct current (DC) type PDP, which performs a facing discharge, and an alternating current (AC) type PDP, which performs a surface discharge. The AC type PDP is more advantageous since it has a lower power consumption and a longer lifetime in comparison with the DC type. For this reason, the AC type PDP has lately attracted considerable attention.

The PDP using the AC driving type applies an alternating current (AC) voltage between electrodes insulated with a dielectric layer, and performs a discharge every half-cycle of the AC voltage. The AC type PDP displays a picture mainly in a sub-field method. In the sub-field method, since the power consumption used to charge and discharge of the PDP panel during a sustain of the discharge is very large, a circuit is used in a driving device of the PDP to recover reactive power.

Generally, the reactive power recovering circuit includes a scanning/sustaining electrode unit that drives cells connected to a Y-electrode (hereinafter, "Y-electrode unit driving cell" 20) and a common electrode unit that drives cells commonly connected to a plurality of X-electrodes (hereinafter, "X-electrode unit driving cell" 30). As shown in FIG. 4, adjacent pairs of the Y-electrodes and the X-electrodes are arrayed in sustaining electrode pairs. The sustaining electrode pairs perform a surface discharge using sustain pulses generated in the Y-electrode unit driving cell 20 and the X-electrode unit driving cell 30. By these pulses, a brightness of the picture displayed on a screen is sustained. A panel capacitor 39 indicates an electrostatic capacity formed between the Y-electrode and the X-electrode in the panel in an equivalent manner.

The Y-electrode unit driving cell 20 includes first and second switches 31 and 33 connected in series between an outside sustaining voltage supply source (Vcc) and a ground (i.e., the Y-electrode), an outside capacitor 43*a* provided in parallel relative to the second switch 33, third and fourth switches 35 and 37 provided between the outside capacitor 43*a* and a first node n1, and a coil 41 connected between the first node n1 and a second node n2. The X-electrode unit driving cell 20 is constructed symmetrically to the Y-electrode unit driving cell 20, with the panel capacitor 39 being in the center therebetween. The X-electrode unit driving cell 30 includes fifth and sixth switches Xs and Xg corresponding to the first and second switches 31 and 33, seventh and eighth switches Xr and Xf corresponding to the third and fourth switches 35 and 37, a coil Lx, and an outside capacitor 43*b*.

Hereinbelow, the operation of the reactive power recovering circuit will be described, focusing on the Y-electrode unit driving cell 20. The panel capacitor 39 is charged with voltage according to the on/off states of each switch 31, 33, 35, 37, Xs, Xg, Xr, Xf of the X and Y-electrode unit driving cells 20 and 30. The voltage charged in the panel capacitor 39 is discharged at the period when the second switch 33 is turned on. If the fourth switch 37 is simultaneously turned on during the discharge of the panel capacitor 39, the electric current flows into the outside capacitor 43*a*, thereby allowing energy to be absorbed thereinto. Then, if the third switch 35 is turned on, the energy absorbed into the outside capacitor 43*a* is recovered by passing through the coil 41, and the panel capacitor 39 is charged again with the energy. Thereafter, the energy is used in a next switching process.

At this time, to supplement insufficient voltage of the panel capacitor 39, the first switch 31 is turned on. The voltage charged in the panel capacitor 39 is discharged depending on the on/off state of each switch Xs, Xg, Xr, Xf within the X-electrode unit driving cell 30, as in the switching process of the Y-electrode unit driving cell 20. Through these processes described above, the X-electrode unit driving cell 30 alternately charges and discharges the panel capacitor 39 with the Y-electrode unit driving cell 20. As a result, the sustaining discharge is available by charging/discharging the panel capacitor 39 by use of the outside capacitors 43*a*, 43*b*, which respectively function as a voltage source.

However, in the conventional reactive power recovering circuit, the construction of the circuit for recovering the energy itself has been very complicated. In addition, the amount of power consumed by each switching device and each diode, to which a plurality of switching devices and a diode to prevent a reverse flow are connected in series, has been large.

SUMMARY OF THE INVENTION

The present invention has been made keeping in mind the above and other problems and shortcomings, and an object of the present invention is to provide a plasma display panel having a reactive power recovering circuit simplified in structure, wherein power consumption is reduced, and a method of controlling the same.

Additional objects and advantages of the invention will be set forth in part in the description which follows and, in part, will be obvious from the description, or may be learned by practice of the invention.

This and other objects of the present invention may be achieved by providing a plasma display panel according to an embodiment of the invention comprising a power supply source to provide a supply voltage, first and second discharge electrodes to perform a surface discharge with the supply voltage from the power supply source, a panel capacitor whose opposite ends are connected to the respective discharge electrodes, the panel capacitor being discharged by supplying a charge voltage to either of the first discharge electrode or the second discharge electrode, a plurality of switches to turn on or off a connection of the panel capacitor connected to the respective discharge electrodes and the power supply source, an inductor provided between the panel capacitor and one of the first and second discharge electrodes, the inductor being charged by a discharge current discharged from the panel capacitor and to inductively store the charge voltage to be recovered for use by the panel capacitor, and a controller to control the switches so as to allow the charge voltage of the panel capacitor to be alternately supplied to the respective discharge electrode.

According to an aspect of the invention, one of the switches comprises a power connecting switch to turn on or off the supply voltage from the power supply source to the panel capacitor, and another one of the switches comprises a ground connecting switch to turn on or off a connection of the panel capacitor with one of the first and second discharge electrodes.

According to another aspect of the invention, the plasma display panel further comprises a resistor connected in series to the power connecting switch in order to reduce an overshoot voltage.

According to yet another aspect of the invention, the switches include field effective transistors (FETs).

According to another embodiment of the present invention, a method of recovering a reactive power of a plasma display panel, which includes a power supply source, a panel capacitor charged with a supply voltage from the power supply source, first and second discharge electrodes performing a surface discharge according to charge/discharge of the panel capacitor, switches to charge/discharge the panel capacitor, and an inductor connected in series to the panel capacitor, the method comprising charging the panel capacitor, discharging the panel capacitor and charging the inductor with a discharged current, forming a first electric current path from the inductor to the panel capacitor and charging the panel capacitor with a charged energy of the inductor, and forming a second electric current path in a reverse direction of the first electric current path and discharging the panel capacitor.

According to a further aspect of the invention, the charging the panel capacitor by the inductor further comprises supplementing insufficient voltage of the panel capacitor with the voltage supplied from the power supply source.

According to a further aspect of the invention, one of the switches includes a power connecting switch to turn on or off a voltage supplied from the power supply source to the panel capacitor, and another of the switches includes a ground connecting switch to turn on or off a connection of the panel capacitor with one of the first and second discharge electrodes.

According to a yet further aspect of the invention, a resistor is connected in series to the power connecting switch, thereby reducing overshoot voltage.

According to a still further aspect of the invention, the switches include field effective transistors (FETs).

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE EMBODIMENTS

Figure 1:
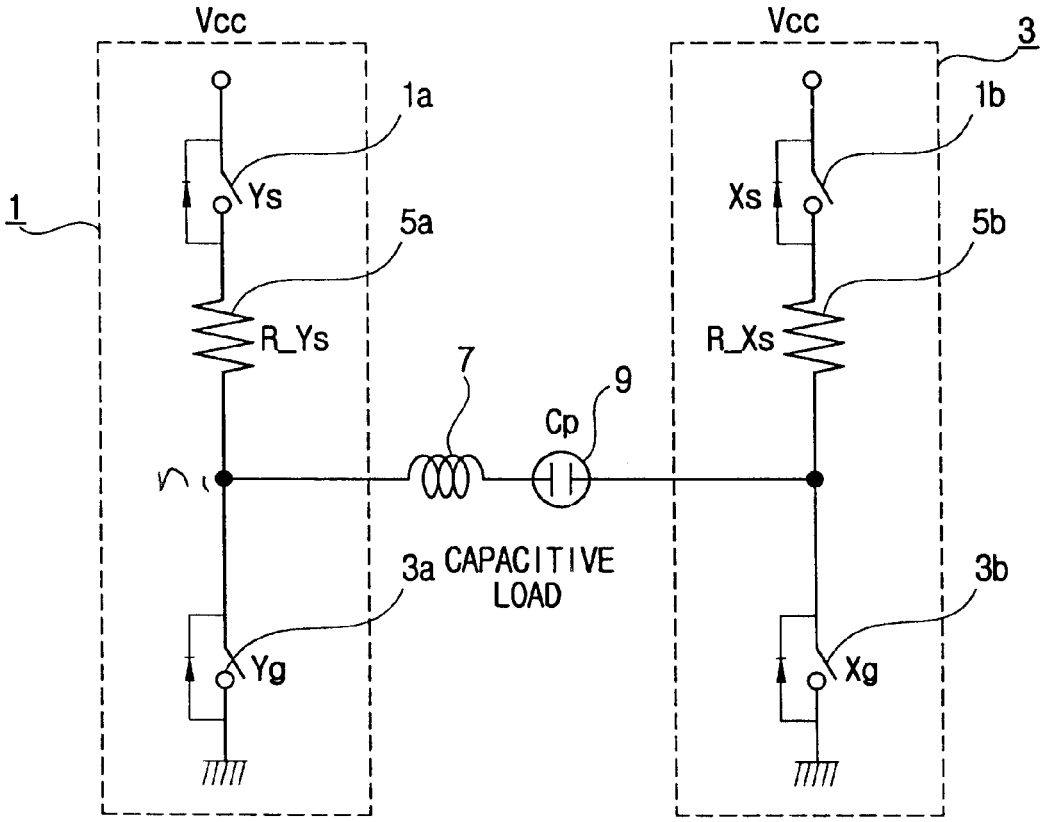
FIG. 1 is a block diagram of a reactive power recovering circuit of a PDP according to an embodiment of the present invention.

Hereinbelow, the present invention will be described in more detail with reference to the accompanying drawings, wherein like reference numerals refer to the like elements throughout. The embodiments are described below in order to explain the present invention by referring to the figures.

FIG. 1 is a block diagram of a reactive power recovering circuit of a PDP according to an embodiment of the present invention. As illustrated therein, a driving circuit driven to generate an electric discharge in discharge sustaining electrode pairs includes a Y-electrode unit driving cell 1 to drive the Y-electrode of the discharge sustaining electrode pair. X-electrode unit driving cells 3 drive the X-electrodes. A controller (not shown) applies a control signal to drive the Y-electrode unit driving cell 1 and the X-electrode unit driving cells 3. A panel capacitor 9 indicates an equivalent capacitance formed between the Y-electrode and the X-electrode in the panel.

The Y-electrode unit driving cell 1 includes first and second switches 1*a* and 3*a*, which are provided between a power supply source (Vcc) and a ground (i.e., the Y-electrode), respectively. The first and second switches 1*a* and 3*a* are turned on or off to charge or discharge the voltage of the panel capacitor 9. A resistor 5*a* is connected in series to the first switch 1*a*.

The X-electrode unit driving cell 3 is structured symmetrically as compared to the Y-electrode unit driving cell 1. The panel capacitor 9 is disposed between the X-electrode unit driving cell 3 and the Y-electrode unit driving cell 1. The X-electrode unit driving cell 3 includes third and fourth switches 1*b* and 3*b*, which correspond to the first and second switches 1*a* and 3*a*, and a resistor 5*b*, which corresponds to the resistor 5*a* and which is connected in series to the third switch 1*b*.

As shown, each resistor 5*a* and 5*b* functions to reduce an overshoot of the voltage of the discharge pulse applied from the first switch 1*a* or the second switch 1*b*, the first and second switches 1*a*, 1*b* being individually turned on at the period during which the panel capacitor 9 is charged using the voltage of the power supply source Vcc. At this time, the controller outputs a control signal to turn on or off each switch 1*a*, 3*a*, 1*b*, 3*b* so as to generate the charge/discharge in the panel capacitor 9. In the charge/discharge process of the panel capacitor 9, the first and third switches 1*a* and 1*b* turn on or off a connection between the panel capacitor 9 and the power supply source Vcc. The second and the fourth switches 3*a* and 3*b* turn on or off a connection between the panel capacitor 9 and the ground (i.e., the X and Y electrodes).

Figures 3A, 3B:
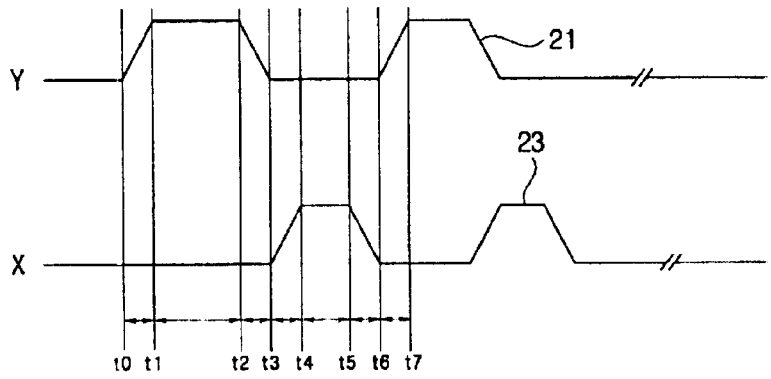
FIGS. 3A and 3B are views showing each voltage at both ends of the panel capacitor of FIG. 1.
Figure 4:
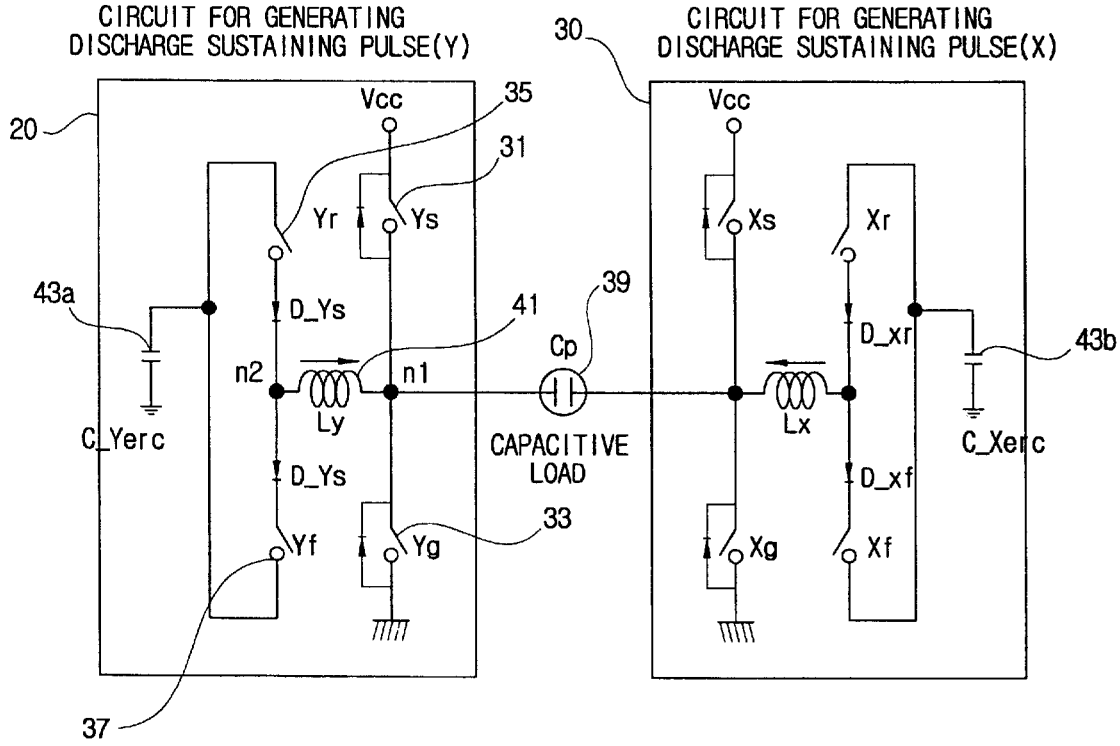
FIG. 4 (PRIOR ART)
FIG. 4 is a circuit diagram for recovering a reactive power of a conventional PDP.

According to an embodiment of the invention, the switches 1*a*, 1*b*, 3*a* and 3*b* are field effect transistors (FETs), and a diode is separately connected to each FET. As each switch 1*a*, 1*b*, 3*a* and 3*b* is turned on or off, a discharge sustain pulse as shown in FIGS. 3A and 3B (to be described later) is generated and supplied to the panel capacitor 9. However, it is understood that other types of switches are possible.

According to the present invention, a coil 7 is used as an inductor to recover the reactive power. The coil 7 is connected in series to one end of the panel capacitor 9 and is connected to a junction point of the power supply source and the ground. At the period of discharge, when the panel capacitor 9 is connected to the ground, the coil 7 is charged with a discharge current flowing from the panel capacitor 9. Thus, the coil 7 recovers energy and is able to later charge the panel capacitor 9 with the recovered energy. That is, if an electric charge of the panel capacitor 9 is completely discharged, the energy charged in the coil 7 applies a reverse voltage to the panel capacitor 9. The energy charged in the coil 7 is transmitted to the panel capacitor 9, thereby recovering the energy. The discharge sustain pulse is supplied to the X-electrode thus uses the energy recovered by the coil 7 and transmitted to the panel capacitor 9.

Figure 2A:
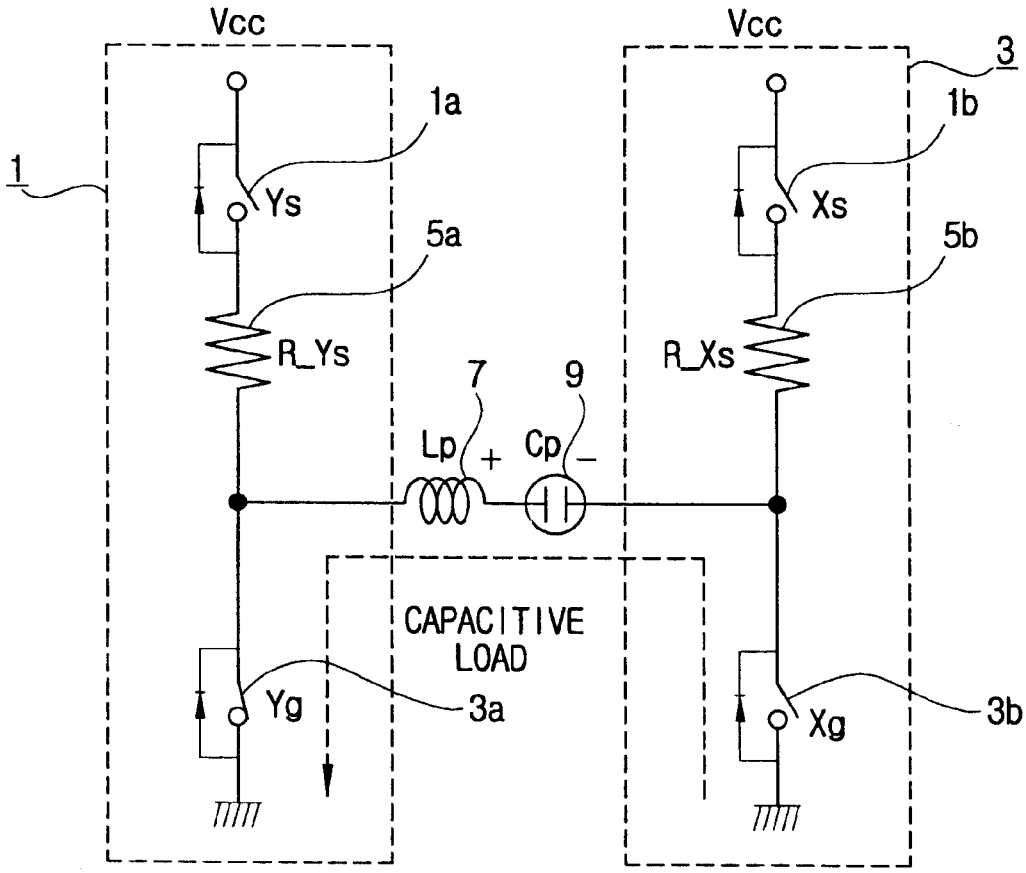
FIGS. 2A, 2B, 2C and 2D show current flows when a panel capacitor of FIG. 1 is charged or discharged.
Figure 2B:
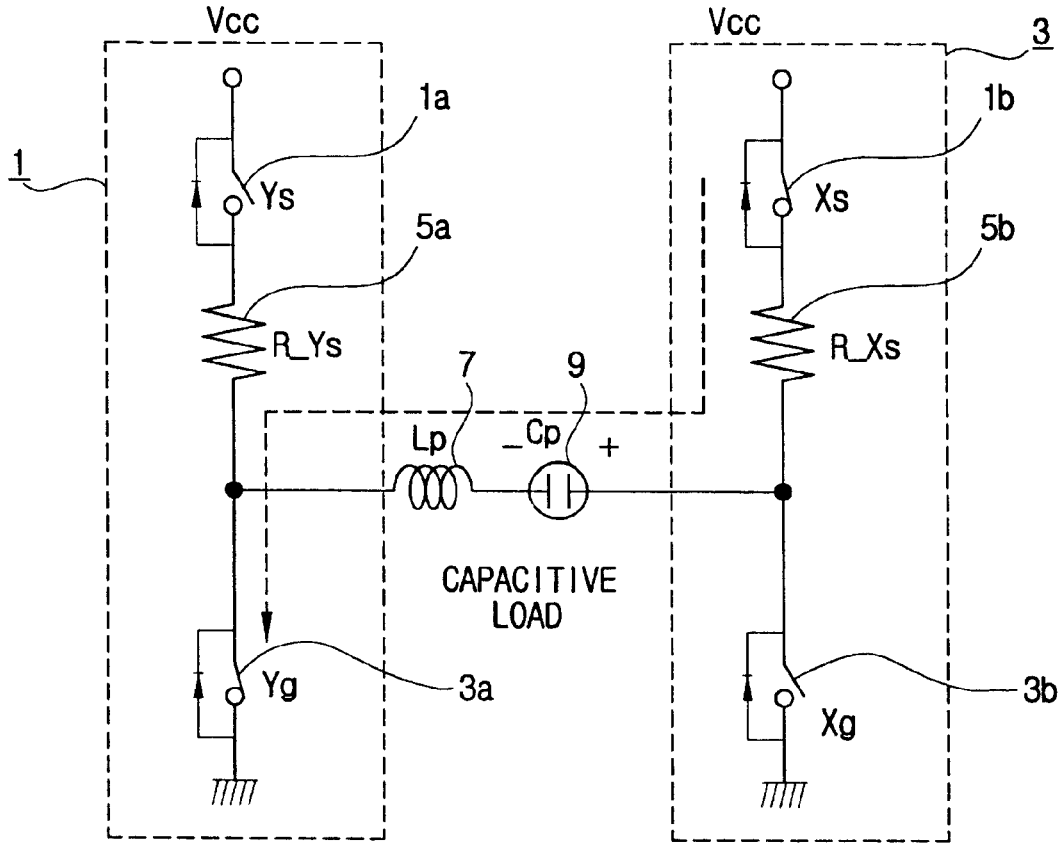

FIGS. 2A and 2B show electric current flows when the panel capacitor 9 is charged/discharged by the Y-electrode unit driving cell 1, and FIGS. 3A and 3B show a voltage wave shape indicating each voltage at both ends of the panel capacitor 9 at the period of charge/discharge thereof. Hereinafter, the charge/discharge processes of the capacitor 9 will be described with reference to FIGS. 3A and 3B, focusing the Y-electrode unit driving cell 1 by way of example.

If the first switch 1 a is turned on, an electric current is supplied from the power supply source Vcc and the panel capacitor 9 is charged with a voltage (during the period of t0~t2 of FIGS. 3A and 3B). If the second switch 3*a* is then turned on to charge the panel capacitor 9, an electric charge with which the panel capacitor 9 is charged is discharged through the ground, after bypassing the coil 7 as shown in FIG. 2A. At this time, the coil 7 is charged with a magnetic energy by a discharge current generated at the period of discharging the panel capacitor 9, and the voltage of the panel capacitor 9 is completely discharged (during the period of t2~t3 of FIGS. 3A and 3B). If the electric charge of the panel capacitor 9 is entirely discharged, a reverse voltage is applied to the panel capacitor 9 by the magnetic energy charged in the coil 7. And, if the magnetic energy is transmitted from the coil 7 to the panel capacitor 9, a somewhat lower voltage than the initial voltage is applied to the panel capacitor 9 and has a polarity opposite to the initial polarity (during the period of t3~t4 of FIGS. 3A and 3B). At this time, the controller (not shown), which generates control signals to selectively switch each switch 1*a*, 3*a*, 1*b*, 3*b* on or off, turns on the second switch 3*a* and the third switch 1*b* so as to supply a voltage to the panel capacitor 9 from the power supply source Vcc, thereby supplementing insufficient voltage of the panel capacitor 9 as shown in FIG. 2B (during the period of t4 of FIGS. 3A and 3B).

Figure 2C:
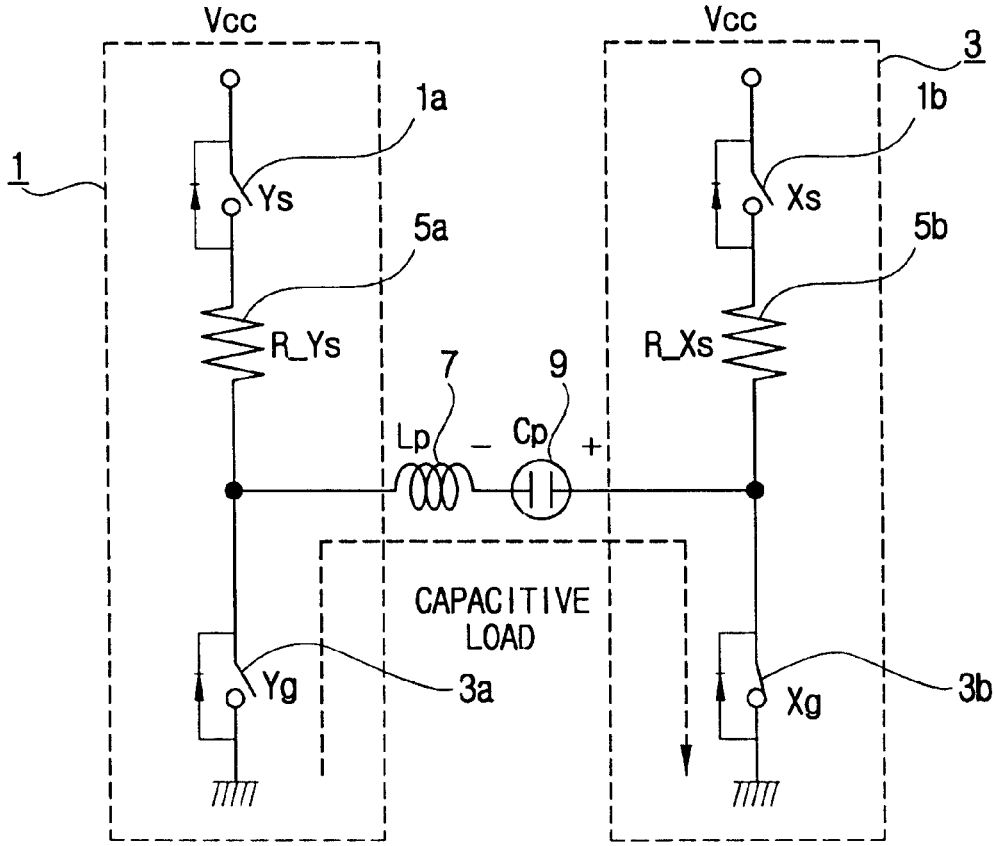
Figure 2D:
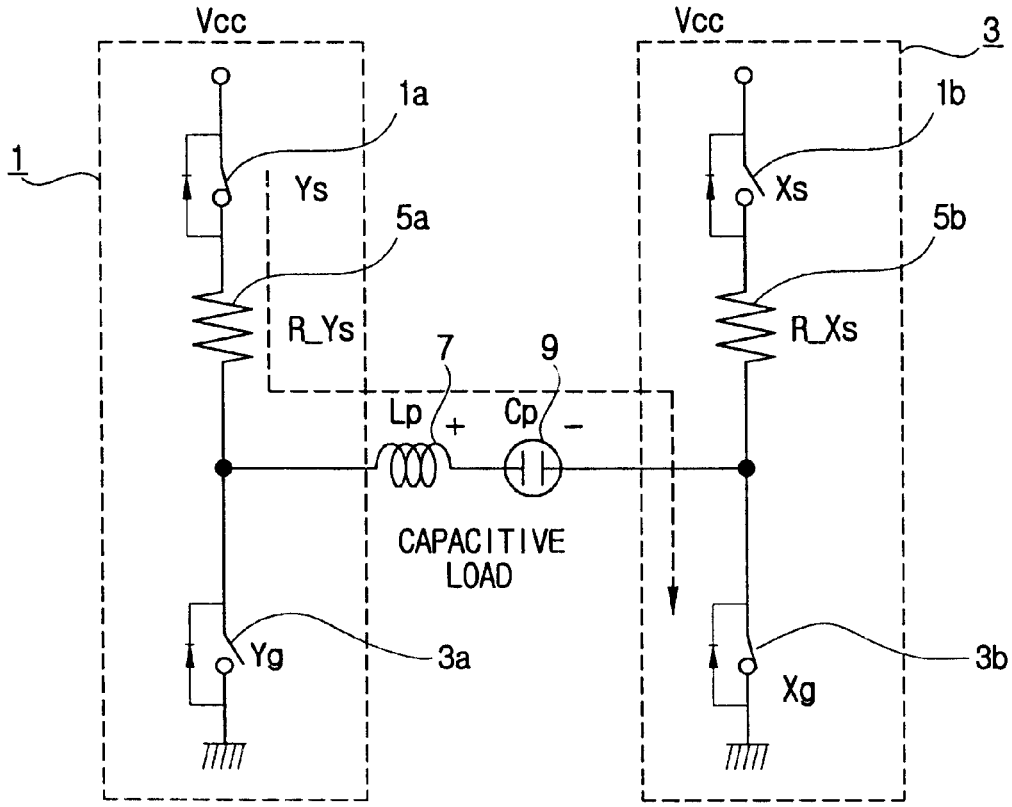

FIGS. 2C and 2D show electric current flows at the period of charge/discharge of the panel capacitor 9 by the X-electrode unit driving cell 3. The charge/discharge at the X-electrode unit driving cell 3 are performed through the same operating processes as of the Y-electrode unit driving cell 1. In the circuit of FIG. 2C, the voltage charged in the panel capacitor 9 is discharged when the fourth switch 3*b* is turned on (during the period of t5~t6 of FIGS. 3A and 3B). During the discharge of the panel capacitor 9, an electric current flows into the coil 7 and the coil 7 is charged with the magnetic energy. If the panel capacitor 9 is completely discharged, a reverse voltage is applied to the panel capacitor 9 by the magnetic energy charged in the coil 7. If the energy is transmitted to the panel capacitor 9 from the coil 7 by the reverse voltage applied to the panel capacitor 9, a somewhat lower voltage than the initial voltage is applied to the panel capacitor 9 with a polarity opposite to the initial polarity (during the period of t6~t7 of FIGS. 3A and 3B). Here, the controller turns on the first and fourth switches 1*a* and 3*b* to supply a voltage to the panel capacitor 9 from the power supply source Vcc, thereby supplementing insufficient voltage of the panel capacitor 9 as shown in FIG. 2D (during the period of t7 of FIGS. 3A and 3B).

In this way, if sustain pulses are alternately supplied to the X-electrode and the Y-electrode by charging/discharging the panel capacitor 9, the discharge is sustained in the discharge sustaining electrode pair. With this configuration, the reactive power recovering circuit recovers discharged voltages at the period of charge/discharge of the panel capacitor and is simplified in structure. In addition, since the number of switching devices of the reactive power recovering circuit is reduced, power consumption is reduced.

Figure 5:
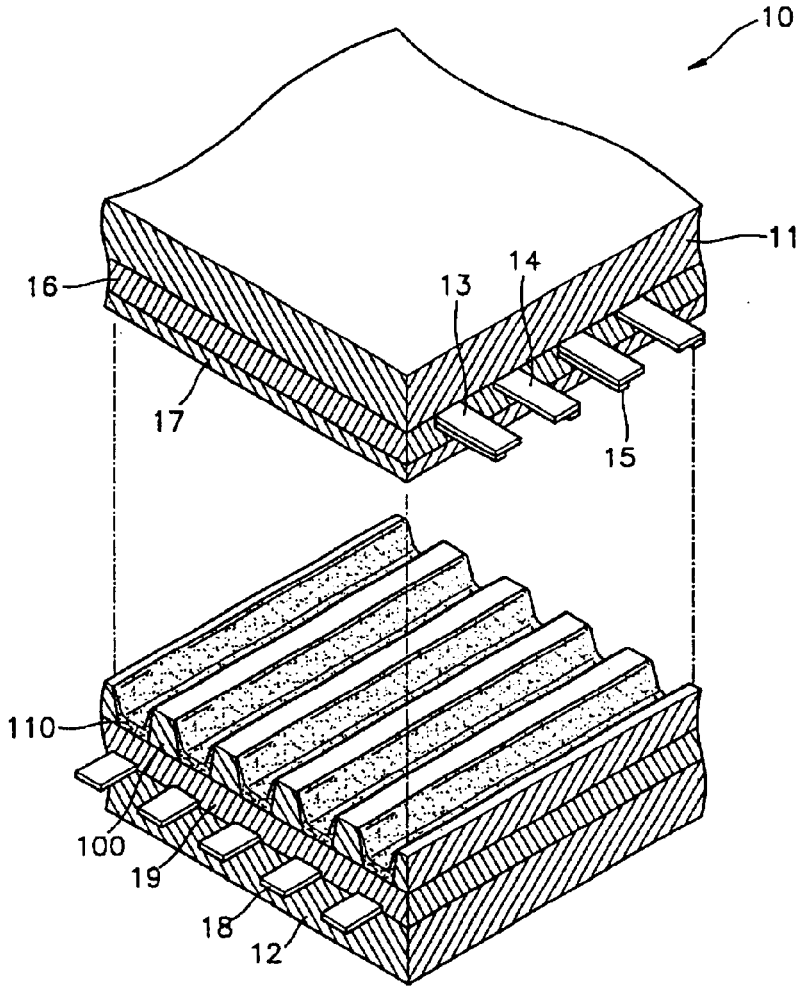
FIG. 5 is a perspective view of a plasma display panel according to an embodiment of the invention.

FIG. 5 shows an AC type plasma display panel 10 using the reactive power recovering circuit according to an embodiment of the invention. The plasma display panel 10 has a front substrate 11 and a rear substrate 12 opposed to and facing each other. Strip-shaped common electrodes 13 and strip-shaped scan electrodes 14 (X and Y electrodes 13, 14) are alternately formed on a bottom surface of the front substrate 11. A bus electrode 15, which reduces the line resistance, is formed on a bottom surface of each of the common and scan electrodes 13 and 14. A first dielectric layer 16 is formed on a bottom surface of the front substrate 11 to cover the common electrodes 13, the scan electrodes 14, and the bus electrodes 15. A protective layer 17, such as a magnesium oxide (MgO), is formed on a bottom surface of the first dielectric layer 16.

Strip-shaped address electrodes 18 are formed on a top surface of the rear substrate 12 to be perpendicular with the common and scan electrodes 13 and 14. The address electrodes 18 are covered by a second dielectric layer 19. Strip-shaped partitions 100 are formed on the second dielectric layer 19 parallel with the address electrodes 18. Red (R), green (G) and blue (B) phosphor layers 110 are formed on the inner walls of the partitions 100.

As described above, according to the present invention, there are provided a plasma display panel equipped with a reactive power recovering circuit simplified in structure and a method of controlling the same. Further, since the number of parts of the reactive power recovering circuit is reduced, power consumption is accordingly reduced.

Although the embodiments of the present invention have been disclosed for illustrative purposes, those skilled in the art will appreciate that various modifications, additions and substitutions are possible, without departing from the scope and spirit of the invention as disclosed in the accompanying claims and equivalents thereof.

What is claimed is:

1. A reactive power recovering circuit for use with a plasma display panel including a power supply source and first and second discharge electrodes disposed to perform a surface discharge with a supply voltage from the power supply source, the circuit comprising:

a panel capacitor having opposite ends, each end being connected to a corresponding one of the first and second discharge electrodes, said panel capacitor being discharged by alternately supplying a charge voltage to the first and second discharge electrodes;

switches to turn on or off a connection between said panel capacitor, the first and second discharge electrodes, and the power supply source;

an inductor provided between said panel capacitor and one of the first and second discharge electrodes, said inductor being charged by a discharge current discharged by said panel capacitor and to inductively store the charge voltage to be recovered for use by said panel capacitor using the discharge current; and a controller to control said switches so as to allow the charge voltage of said panel capacitor to be alternately supplied to the first and second discharge electrodes.

2. The reactive power recovering circuit according to claim 1, wherein:

one of said switches comprises a power connecting switch to turn on or off the supply voltage supplied by the power supply source to said panel capacitor, and another one of said switches comprises a ground connecting switch to turn on or off a connection between said panel capacitor with one of the first and second discharge electrodes.

3. The reactive power recovering circuit according to claim 2, further comprising a resistor connected in series to the power connecting switch and which reduces an overshoot voltage.

4. The reactive power recovering circuit according to claim 3, wherein said switches comprise field effective transistors (FETs).

5. A method of recovering reactive power of a plasma display panel including a power supply source, a panel capacitor charged with a supply voltage from the power supply source, first and second discharge electrodes performing a surface discharge according to charge/discharge of the panel capacitor, switches to charge/discharge the panel capacitor, and an inductor connected in series to the panel capacitor, the method comprising:

charging the panel capacitor;

discharging the panel capacitor and charging the inductor with a discharged current from the panel capacitor;

forming a first electric current path from the inductor to the panel capacitor and charging the panel capacitor with a charged energy of the inductor; and forming a second electric current path in a reverse direction of the first electric current path and discharging the charged energy from the panel capacitor.

6. The method according to claim 5, wherein said charging the panel capacitor by the inductor further comprises supplementing insufficient voltage of the panel capacitor with the voltage supplied from the power supply source to achieve a desired voltage level for discharge.

7. The method according to claim 5, wherein:

one of the switches comprises a power connecting switch to turn on or off the voltage supplied from the power supply source to the panel capacitor, and another of the switches comprises a ground connecting switch to turn on or off a connection between the panel capacitor and one of the first and second discharge electrodes.

8. The method according to claim 7, further comprising reducing an overshoot voltage using a resistor connected in series to the power connecting switch.

9. The method according to claim 8, wherein the switches comprise field effective transistors (FETs).

10. The reactive power recovering circuit according to claim 1, wherein said inductor is charged both when said panel capacitor charges the first discharge electrode and when said panel capacitor charges the second discharge electrode.

11. The reactive power recovering circuit according to claim 10, wherein:

said inductor is charged using a first discharge current from said panel capacitor to the first discharge electrode when said panel capacitor supplies the charge voltage to the first discharge electrode, and said inductor is also charged using a second discharge current from said panel capacitor to the second discharge electrode when said panel capacitor supplies the charge voltage to the second discharge electrode.

12. The reactive power recovering circuit according to claim 1, wherein said inductor charges said panel capacitor after said panel capacitor is discharged after charging the first discharge electrode and after said panel capacitor is discharged after charging the second discharge electrode.

13. The method according to claim 5, further comprising again charging the inductor during said forming the second electric current path.

14. The method according to claim 5, wherein said discharging the panel capacitor and charging the inductor comprises forming a third electric current path in a same direction as the first electric current path, discharging the panel capacitor, and charging the inductor.

15. A plasma display panel, comprising:

a front substrate;

first and second discharge electrodes disposed along a first direction on a bottom surface of said front substrate;

a first dielectric layer on the bottom surface of said front substrate to cover said first and second discharge electrodes;

a rear substrate opposite to and facing said front substrate;

address electrodes on a top surface of said rear substrate, said address electrodes being disposed in a second direction non-parallel with the first direction of said first and second discharge electrodes;

a second dielectric layer on said rear substrate to cover said address electrodes;

partitions to partition a discharge space under said first dielectric layer, said partitions being on said second dielectric layer;

phosphor layers formed on inner walls of said partitions;

a power supply source to supply a supply voltage for use in performing a surface discharge using said first and second discharge electrodes; and a reactive power recovering circuit comprising:

a panel capacitor having opposite ends, each end being connected to a corresponding one of said first and second discharge electrodes, the panel capacitor being discharged by alternately supplying a charge voltage to said first and second discharge electrodes, and an energy storage device provided between the panel capacitor and one of said first and second discharge electrodes, the energy storage device being charged by a discharge current from the panel capacitor and to store the charge voltage to be recovered for use by the panel capacitor using the discharge current.

16. The plasma display panel according to claim 15, wherein:

the energy storage device comprises an inductor, and said reactive power recovering circuit further comprises:

switches to turn on or off a connection between the panel capacitor, said first and second discharge electrodes, and said power supply source, and a controller to control the switches so as to allow the charge voltage of the panel capacitor to be alternately supplied to said first and second discharge electrodes.

17. The plasma display panel according to claim 16, wherein:

one of the switches comprises a power connecting switch to turn on or off the supply voltage supplied by said power supply source to the panel capacitor, and another one of the switches comprises a ground connecting switch to turn on or off a connection between the panel capacitor with one of said first and second discharge electrodes.

18. The plasma display panel according to claim 17, wherein said reactive power recovering circuit further comprises a resistor connected in series to the power connecting switch in order to reduce an overshoot voltage.

19. The plasma display panel according to claim 18, wherein the switches comprise field effective transistors (FETs).

20. The plasma display panel according to claim 15, wherein the energy storage device is charged when the panel capacitor discharges so as to charge said first discharge electrode and when the panel capacitor discharges so as to charge said second discharge electrode.

21. The plasma display panel according to claim 15, wherein the energy storage device stores energy using a magnetic field when the panel capacitor discharges so as to charge said first discharge electrode and when the panel capacitor discharges so as to charge said second discharge electrode.

22. The plasma display panel according to claim 15, wherein said reactive power recovering circuit further comprises:

a first discharge electrode driving unit connected between said power supply source, the panel capacitor, and said first discharge electrode, a second discharge electrode driving unit connected between said power supply source, the panel capacitor, and said second discharge electrode, and the energy storage device is connected in series with the panel capacitor between the first and second discharge electrode driving units.

23. The plasma display panel according to claim 22, wherein:

the energy storage device is connected between the panel capacitor and a node, and the node connects said power supply source and one of said first and second discharge electrodes.

24. The plasma display panel according to claim 22, wherein the energy storage device is charged when a current path is formed between said second discharge electrode, the panel capacitor, and the supply voltage provided by said power supply source through the first discharge electrode driving unit.

25. The plasma display panel according to claim 22, wherein the energy storage device is charged when a current path is formed between said first discharge electrode, the panel capacitor, and the supply voltage provided by said power supply source through the second discharge electrode driving unit.

* * * * *